United States Patent [19]

Matsumoto

[11] Patent Number: 4,993,967

[45] Date of Patent: Feb. 19, 1991

[54] ELECTRIC CONNECTOR WITH A DOUBLE LOCKING MECHANISM

[75] Inventor: Mitsuru Matsumoto, Shizuoka, Japan

[73] Assignee: Yazaki Corporation, Tokyo, Japan

[21] Appl. No.: 538,341

[22] Filed: Jun. 13, 1990

[30] Foreign Application Priority Data

Jul. 3, 1989 [JP] Japan ..... 1-169846

[51] Int. Cl.[5] ..... H01R 3/00

[52] U.S. Cl. ..... 439/489; 439/352

[58] Field of Search ..... 439/347, 352, 354, 488, 439/489, 595

[56] References Cited

U.S. PATENT DOCUMENTS

| | | | |
|---|---|---|---|
| 4,370,013 | 1/1983 | Niitsu et al. | 439/352 |
| 4,634,204 | 1/1987 | Detter et al. | 439/347 |
| 4,708,413 | 11/1987 | Schroeder | 439/352 X |
| 4,810,210 | 3/1989 | Komatsu | 439/352 X |
| 4,884,978 | 12/1989 | Inaba et al. | 439/352 |

*Primary Examiner*—David L. Pirlot
*Assistant Examiner*—J. R. Daulton
*Attorney, Agent, or Firm*—Armstrong, Nikaido, Marmelstein, Kubovcik & Murray

[57] ABSTRACT

An electric connector with a double locking mechanism for connecting the electrical conductors of electric circuits on a vehicle. The electric connector with a double locking mechanism comprises a male connector provided with a locking arm having a locking projection, a female connector housing provided with a slot for receiving the locking projection of the locking arm for primary locking when the male connector housing and the female connector housing are joined perfectly together, a locking slider mounted on the female connector housing for sliding movement toward and away from the male connector housing between a first position and a second position, and a spring basing the locking slider to the releasing position. When the male and female connector housings are joined perfectly together, the locking projection is received in the slot of the female connector housing and engages the female connector housing for primary locking. The locking slider is able to engage the first or second connector housing for secondary locking only when the male and female connector housings are joined perfectly together. Thus, the male and female connector housings are locked double when perfectly joined together. When the male and female connector housings are joined imperfectly, the locking slider is unable to stay at the second position and is returned automatically to the first position by the spring.

3 Claims, 5 Drawing Sheets

ELECTRIC CONNECTOR WITH A DOUBLE LOCKING MECHANISM

BACKGROUND OF THE INVENTION

1. Field of the Invention

The present invention relates to an electric connector with a double locking mechanism for connecting electrical conductors on a vehicle.

2. Description of the Prior Art

The electric connector has a pair of connector housings, which are mated together to join the male and female contactors electrically and mechanically, and is provided, in general, with a locking mechanism to secure the electrical connection of the male and female contactors.

Referring to FIG. 5 showing a conventional electric connector with a locking mechanism, a locking arm b provided with a locking projection c is fixed at one end to the upper wall of a male connector housing a in a cantilever fashion for elastic bending in a vertical plane, and a locking hole f is formed in the hood e of a female connector housing d. When the male connector housing a and the female connector housing d are joined properly, the locking projection c of the locking arm b engages the locking hole f of the female connector housing d to lock the electric connector. The male connector housing a is provided with an arm guard g to prevent the bending of the locking arm b by an external force.

The locking force of the locking arm b may be enhanced when the same is supported at its opposite ends. However, it is difficult to support the locking arm b at its opposite ends without entailing difficulty in joining and separating the male and female connector housings. It is possible that the electric connector is unlocked if an external force acts perpendicularly to the locking arm b.

The possibility of faulty joining of the contactors is inevitable in joining the male and female connector housings by hand, and it is difficult to find faulty connection of the contactors by visual inspection because there are so many electric connectors to be inspected. Such an faulty connection of the contactors of an electric connector for joining the electric conductors of a circuit relating to a safety device of an automobile, such as an air bag device, is fatal to the driver in case of a motor vehicle accident. Accordingly, a further reliable locking mechanism has been desired.

SUMMARY OF THE INVENTION

Accordingly, it is an object of the present invention to provide an electric connector with a highly reliable double locking mechanism facilitating the joining and separation of the male and female connector housing of the electric connector, capable of double-locking the electric connector without requiring a locking arm having a very high locking force, and capable of automatically detecting the incomplete joining of the male and female connector housing of the electric connector.

In one aspect of the present invention, an electric connector with a double locking mechanism comprises: a female connector housing; a male connector housing capable of being fitted in the female connector housing and provided with a locking arm extending backward and provided with a locking projection; a locking slider longitudinally movably mounted on the rear end of the female connector housing; and a spring biasing the locking slider backward; characterized in that a slider chamber for receiving the locking slider is formed in the female connector housing, holding means for holding the locking slider in a temporary locking state is provided between the slider chamber and the locking slider, and locking means including components provided respectively on the locking slider and the male connector housing so as to engage each other when the male and female connector housing are joined together with the locking projection of the locking arm engaging the female connector housing to lock the male and female connector housings.

Thus, the perfect joining of the male and female connector housings is confirmed by the perfect engagement of the component of the locking means and the male and female connector housings are double-locked by the locking means and the locking arm to secure correct connection of the contactors.

BRIEF DESCRIPTION OF THE DRAWINGS

The above and other objects, features and advantages of the present invention will become more apparent from the following description taken in connection with the accompanying drawings, in which.

DETAILED DESCRIPTION OF THE PREFERRED EMBODIMENTS

Figure 1:
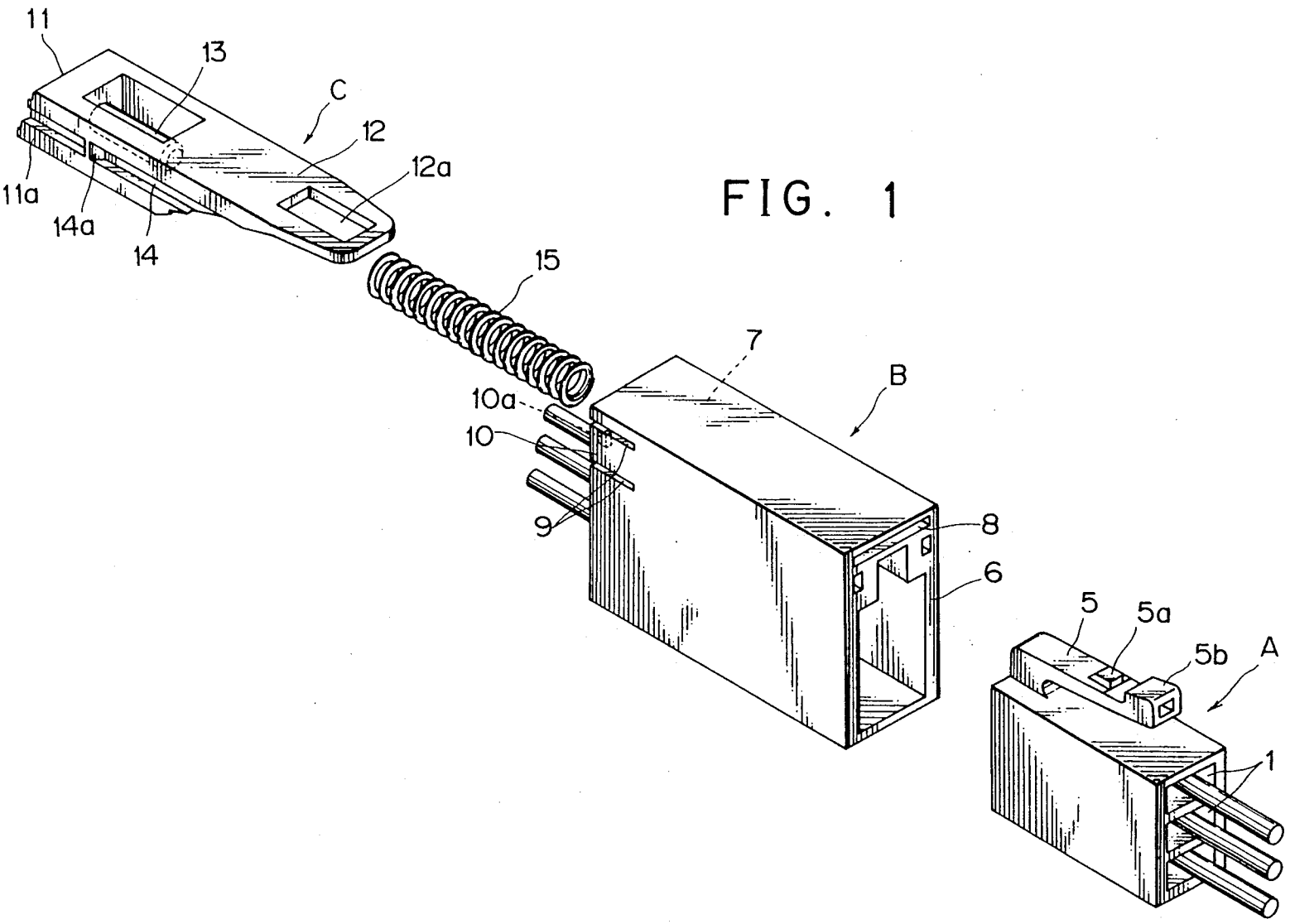
FIG. 1 is an exploded perspective view of an electric connector with a double locking mechanism in a first embodiment according to the present invention.
Figure 2:
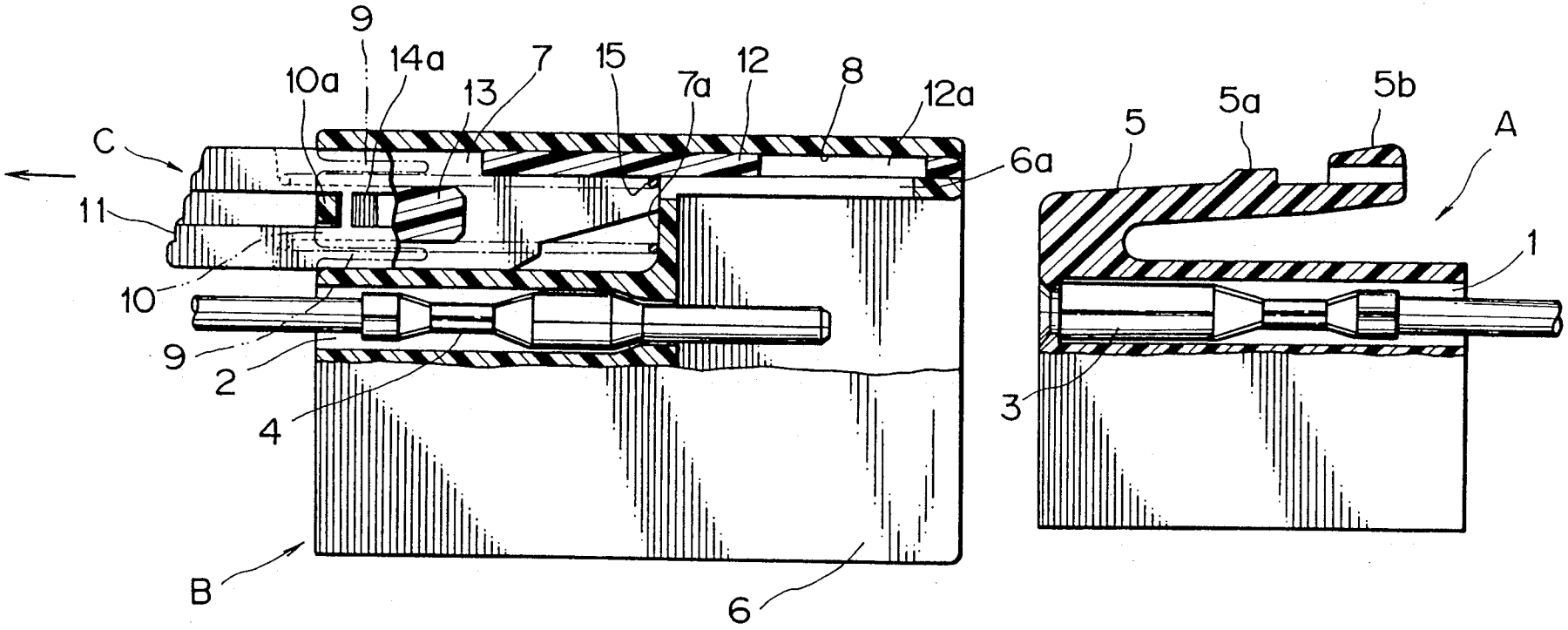
FIG. 2 is a partially sectional view of the electric connector with a double locking mechanism shown in FIG. 1, in which male and female connector housings are separated.

Referring to FIGS. 1 and 2, an electric connector with a double locking mechanism in a first embodiment according to the present invention comprises a male connector housing A formed of a synthetic resin, a female connector housing B formed of a synthetic resin, and a locking slider C formed of a synthetic resin. A plurality of contactor chambers 1 are formed in the male connector housing A, and female contactors 3 are fitted fixedly in the contactor chambers 1, respectively. A plurality of contactor chambers 2 are formed in the female connector housing B, and male contactors 4 are fitted fixedly in the contactor chambers 2, respectively. The male connector housing A is provided on its upper wall with a locking arm 5 extending obliquely upward from the front end of the upper wall. The locking arm 5 is provided with a locking projection 5*a* at a position between the front end and the rear end and a push knob 5*b* at the rear end or the free end. A hood 6 for receiving the front portion of the male connector housing A is formed in the front half of the female connector housing B, and a slot 6*a* for receiving the locking projection 5*a* is formed in the upper wall of the hood 6. A slider chamber 7 for receiving the body 11 of the locking slider C is formed in the rear half of the female connector housing B. A guide way 8 for guiding the locking finger 12 of the locking slider C for forward and backward movement is formed in the female connector housing B from the slider chamber 7 to the front end of the hood 6. Two longitudinal, parallel slots 9 are formed in the rear end of each of the side walls of the female connector housing B to form a flexible stopping tongue 10. A stopping projection 10*a* is formed on the inner surface of the flexible stopping tongue 10.

The locking finger 12 of the locking slider C extends to the front from the body 11 having the shape of a channel, and is provided with a slot 12*a* for receiving the push knob 5*b* of the locking arm 5. The body 11 is provided therein with a spring guide pin 13, and a coil spring 15 is mounted on the spring guide pin 13. Longitudinal guide grooves 14 are formed in the outer surfaces of the side walls 11*a* of the body 11 at positions corresponding to the stopping projections 10*a* of the flexible stopping tongues 10, respectively. Stoppers 14*a* are formed in the guide grooves 14, respectively.

Referring to FIG. 2, the locking slider C with the coil spring 15 mounted on the spring guide pin 13 is inserted in the slider chamber 7 so that the locking finger 12 is received in the guide way 8. As the locking slider C is pushed into the slider chamber 7 compressing the coil spring 15, the stoppers 14*a* of the locking slider C engage the stopping projections 10*a* of the flexible tongues 9 and advance over the stopping projections 10*a* bending the flexible tongues 9 outward. Thus, the locking slider C is restrained from moving backward for temporarily latching at a first position by the engagement of the stoppers 14*a* and the corresponding stopping projections 10*a*. In this state, the locking slider C is biased backward, namely, in a direction indicated by an arrow, by the compressed coil spring 15.

Figure 3:
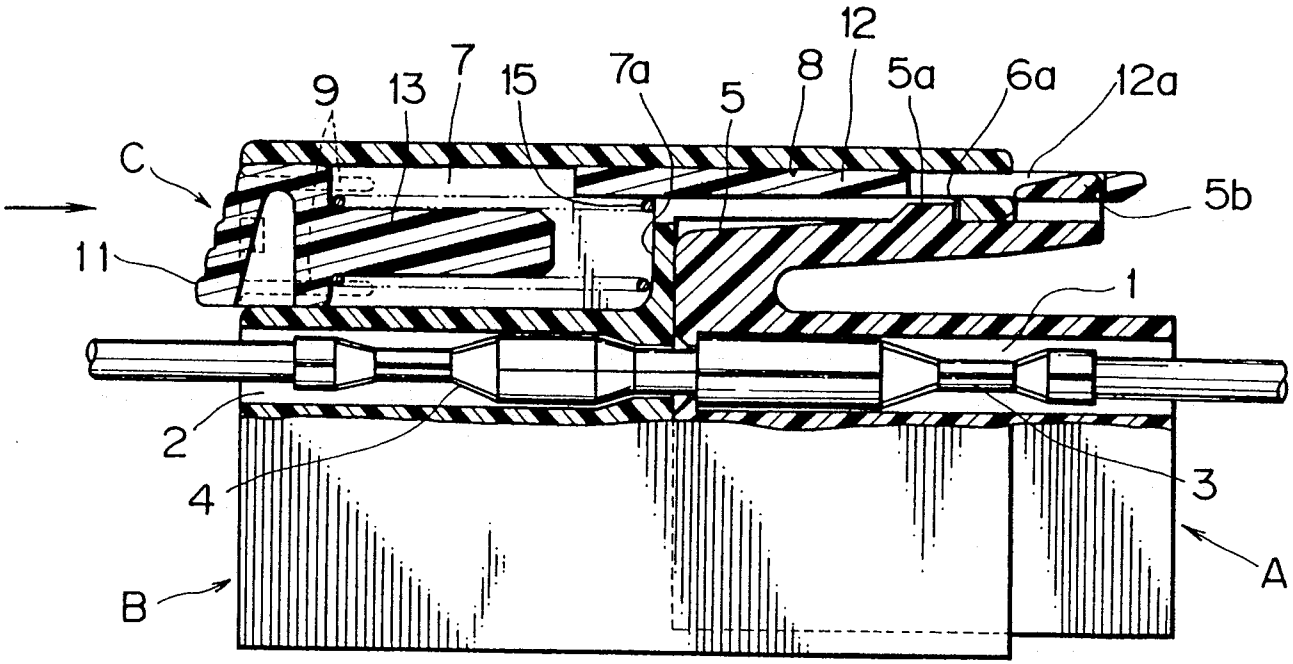
FIG. 3 is a partially sectional view of the electric connector with a double locking mechanism shown in FIG. 1, in which the male and female connector housings are joined together.

Referring to FIG. 3, the male connector housing A is fitted in the hood 6 of the female connector housing B so that the locking projection 5*a* of the locking arm 5 is received in the slot 6*a* of the hood 6 to lock the male connector housing A to the female connector housing B for primary locking. In this state, the female contactors 3 of the male connector housing A and the corresponding male contactors 4 of the female connector housing B are connected electrically. Then, the locking slider C is pushed to the front, namely, in a direction indicated by an arrow, against the resilience of the coil spring 15 until the push knob 5*b* of the locking arm 5 is received in the slot 12*a* of the locking finger 12 at a second position for secondary locking. Thus, the male connector housing A and the female connector housing B are locked double by the engagement of the locking projection 5*a* of the locking arm 5 and the hood 6 of the female connector housing B, and the engagement of the push knob 5*b* of the locking arm 5 and the locking finger 12 of the second slider C. If the locking slider C is not pushed to the locking position, the locking slider C is unable to stay at the locking position and is pushed back automatically by the coil spring 15. If the male connector housing A is fitted imperfectly in the hood 6 of the female connector housing B, the push knob 5*b* of the locking arm 5 of the male connector housing A is unable to be received in the slot 12*a* of the locking finger 12 of the locking slider C even if the locking slider C is pushed to the second position. In either case, the locking slider C is pushed back automatically by the coil spring 15 to the first position as shown in FIG. 2. Thus, the condition of joining the male connector housing A and the female connector housing B can be detected from the position of the locking slider C, so that incomplete joining of the male connector housing A and the female connector housing B can be obviated.

Figure 4:
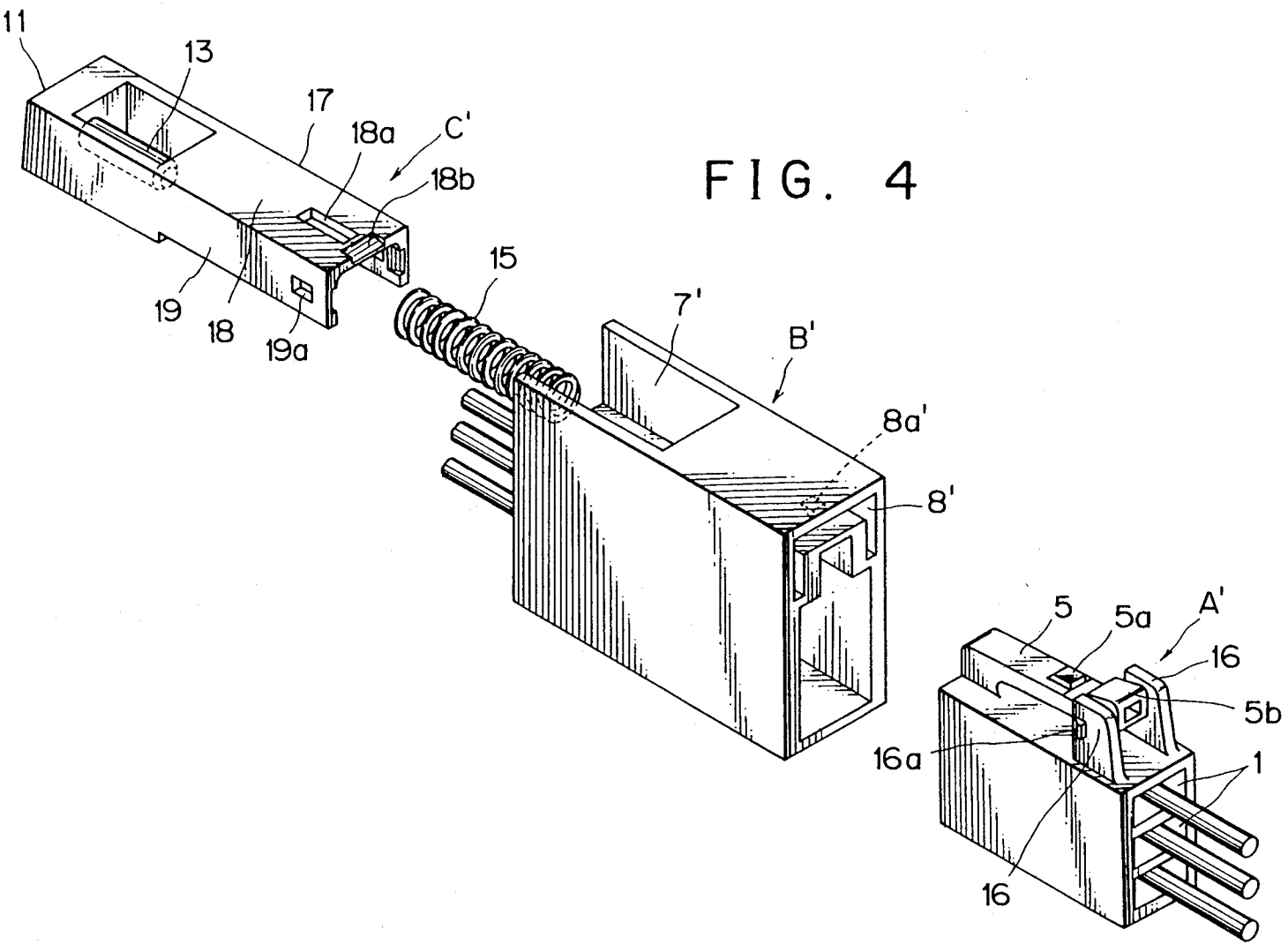
FIG. 4 is an exploded perspective view of an electric connector with a double locking mechanism in a second embodiment according to the present invention.
Figure 5:
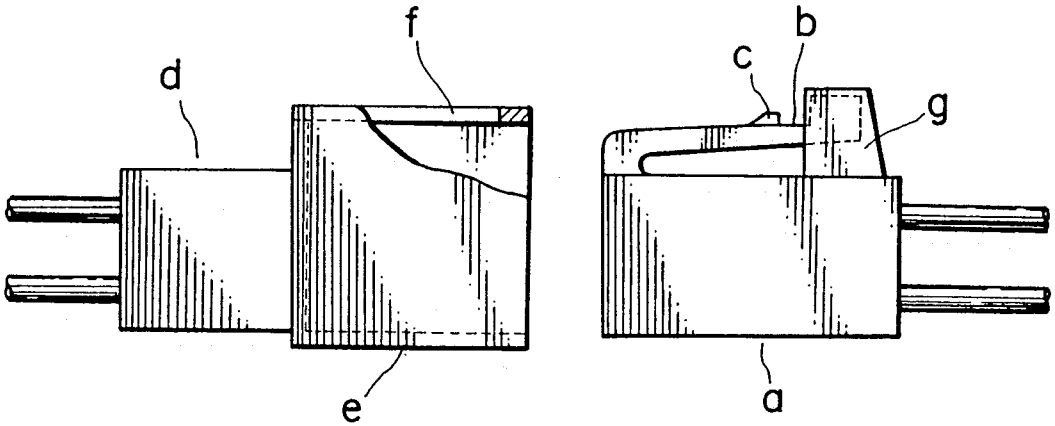
FIG. 5 PRIOR ART
FIG. 5 is a side elevation of a conventional electric connector with a locking mechanism.

FIG. 4 shows an electric connector in a second embodiment according to the present invention, in which parts like or corresponding to those previously described with reference to FIGS. 2 and 3 are denoted by the same reference characters and the description thereof will be omitted to avoid duplication. A male connector housing A′ is provided on its upper wall with a locking arm 5 provided with a locking projection 5*a* at a position between its front and rear ends, and a push knob 5*b* at its rear end. A pair of arm guards 16 are formed on the upper wall of the male connector housing A′ on both the lateral sides of the locking arm 5 so as to receive the push knob 5*b* of the locking arm 5 therebetween. The arm guards 16 are provided on their outer side surfaces respectively with locking projections 16*a*.

A locking slider C′ consists of a body 11 having the shape of a channel, and a locking finger 17 having the shape of a channel. The locking finger 17 has an upper wall 18 and side walls 19. The upper wall 18 of the locking finger 17 is provided with a slot 18*a* near its front end, and a guide slope 18*b* in its front end. The side walls 19 are provided with slots 19*a* for receiving the stopping projections 16*a* of the arm guards 16, respectively. The rear portion of the upper wall of a female connector housing B′ corresponding to a slider chamber 7′ is removed so as to conform to the shape of the locking slider C′. A guide way 8′ having a U-shaped cross section, which corresponding to the guide way 8 shown in FIG. 1, is formed in the female connector housing B′. A stopping projection 8*a′* is formed on the inner surface of the upper wall of the female connector housing B′ so as to be received in the slot 18*a* of the locking slider C′ when the locking slider C′ with a coil spring 15 mounted on a spring guide 13 is pushed in the slider chamber 7′ to the first position. When the locking slider C′ is pushed in the slider chamber 7′ to the first position, the stopping projection 8*a′* engages the upper wall 18 of the locking finger 17 to hold the locking slider C′ at the first position.

When the male connector housing A′ and the female connector housing B′ are joined perfectly together, the locking projection 5*a* of the locking arm 5 engages the inner upper wall of the female connector housing B′ to lock the male connector housing A′ to the female connector housing B′ for primary locking. Then, the locking slider C′ is pushed from the first position to the second position and, consequently, the locking projections 16*a* of the arm guard 16 are received in the slots 19*c* of the side walls 19 of the locking finger 17 and engage the side walls 19 of the locking finger 17 for secondary locking. Thus, the male connector housing A′ and the female connector housing B′ are locked double. Since the push knob 5*b* is enclosed by the upper wall 18 of the locking finger 17 of the locking slider C′ and the arm guards 16 so that the push knob 5*b* may not be exposed to an external force, the male connector housing A′ and the female connector housing B′ are never unlocked accidentally by an external force.

Although the invention has been described in its preferred forms with a certain degree of particularity, obviously many changes and variations are possible therein. It is therefore to be understood that the present invention may be practiced otherwise than as specifically described herein without departing from the scope and spirit thereof.

What is claimed is:

1. An electric connector with a double locking mechanism, comprising:

a first connector housing;

a second connector housing to be mated with the first connector housing;

primary locking means provided between said first connector housing and said second connector housing to lock said first connector housing and said second connector housing when said first connector housing and said second connector housing are fully engaged;

a locking slider mounted on said second connector housing slidably in axial directions and biased rearwardly, said locking slider being adapted to be temporarily latched to said second connector at a first position; and secondary locking means for locking said locking slider to said first connector housing at a second position forwardly of said first position when said first connector housing and said second connector housing are fully engaged.

2. An electric connector as set forth in claim 1, wherein said locking slider includes a planar member; said primary locking means including a locking arm extending from said first connector housing and having a locking projection thereon to engage said second connector housing; and said secondary locking means including a push knob formed in a forwardmost end of said locking arm and a slot formed in a forward portion of the locking slider to receive said push knob.

3. An electric connector as set forth in claim 1, wherein said locking slide includes a channel-shaped member having an upper wall and side walls extending from said upper wall; said primary locking means includes a locking arm extending from said first connector housing and having a locking projection thereon to engage second connector housing; and said secondary locking means includes a pair of arm guards erected from said first housing on two lateral sides of said locking arm, a locking projection on at least one of the arm guides thereon and a slot formed in one of said side walls to receive said locking projection therein.

* * * * *